United States Patent [19]

Koo

[11] Patent Number: 4,580,079

[45] Date of Patent: Apr. 1, 1986

[54] MULTIFILAMENT BULB WITH FILAMENT SWITCHING DEVICE

[76] Inventor: Ronald Koo, 29 Greenwood Rd., Morris Plains, N.J. 07950

[21] Appl. No.: 607,696

[22] Filed: May 7, 1984

Related U.S. Application Data

[63] Continuation-in-part of Ser. No. 176,677, Aug. 11, 1980, Pat. No. 4,447,760.

[51] Int. Cl.[4] ..... H05B 39/10

[52] U.S. Cl. ..... 315/65; 315/90

[58] Field of Search ..... 315/65, 90

[56] References Cited

U.S. PATENT DOCUMENTS

| | | | |
|---|---|---|---|
| 1,838,372 | 12/1931 | DeCastro | 315/65 |
| 2,049,338 | 7/1936 | Trope | 315/65 |
| 4,447,760 | 5/1984 | Koo | 315/65 |

*Primary Examiner*—Harold Dixon

*Attorney, Agent, or Firm*—Edward R. Weingram

[57] ABSTRACT

A filament switching device is arranged to be mounted within the screw base of a conventional, dual-filament, incandescent light bulb. The device has a frame which branches around the evacuation tube of the bulb thereby allowing sufficient room for switching components within the device and yet avoiding interference with the evacuation tube of the bulb. Mounted within the frame of the switching device is a fixed contact and a cantilevered contact. The cantilevered contact can swing in a direction transverse to the evacuation tube to make electrical contact with the fixed contact. The cantilevered contact is held separated from the fixed contact by a fusible conductor. Upon failure of one of the filaments in the bulb, a surge of current flows through the fusible conductor, parting it and allowing the cantilevered contact to swing into electrical contact with the fixed contact. This swing of the cantilevered contact substitutes the failed filament with the other filament.

20 Claims, 17 Drawing Figures

FIG. 1
PRIOR ART
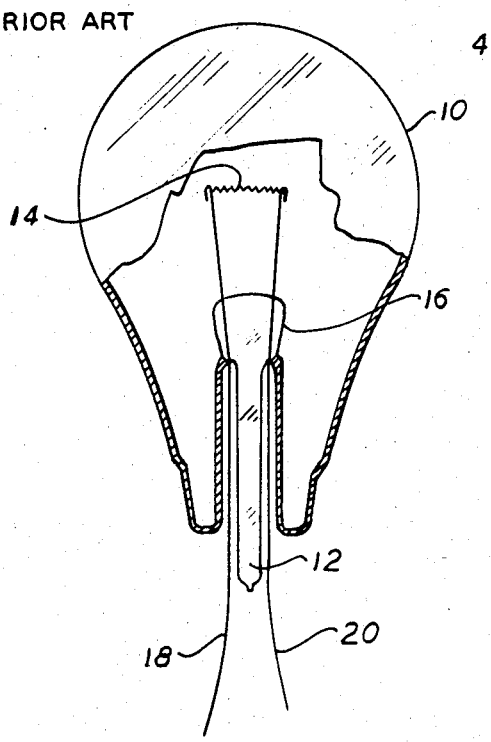
FIG. 3
PRIOR ART
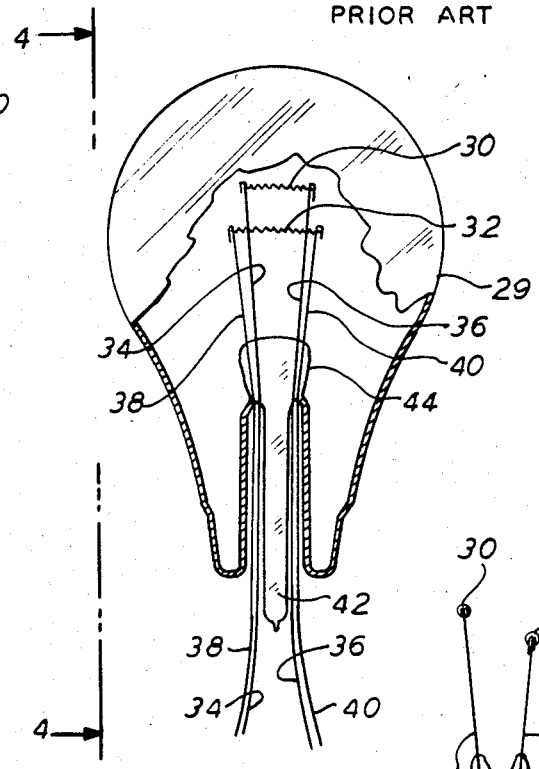
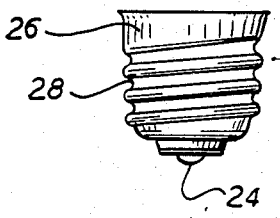
FIG. 2
PRIOR ART
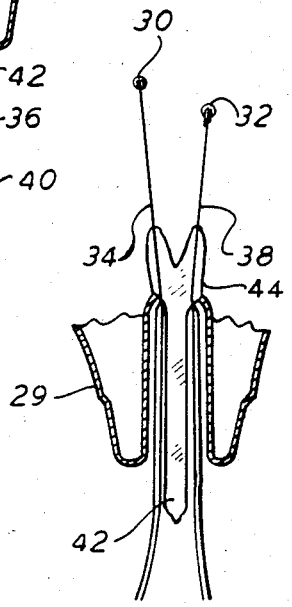
FIG. 4
PRIOR ART
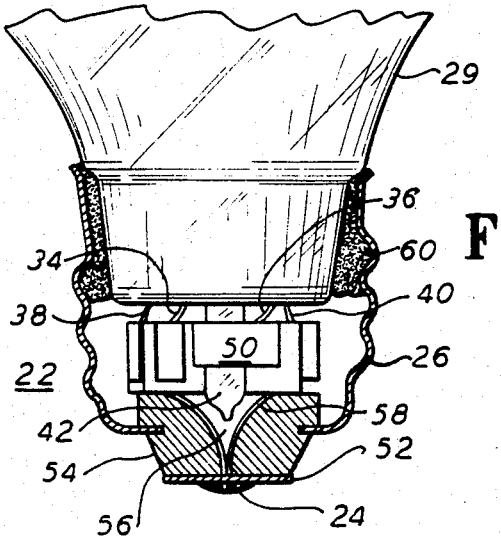
FIG. 5

216
296
256
250
264
218
254
252
246
294
260
230
222
220
228
226
208
224
210
232

MULTIFILAMENT BULB WITH FILAMENT SWITCHING DEVICE

BACKGROUND OF THE INVENTION

1. Field of the Invention

This is a continuation-in-part application of application Ser. No. 176,677, field Aug. 11, 1980, now U.S. Pat. No. 4,447,760, issued May 8, 1984, entitled "Filament Switching Device".

The present invention relates to filament switching devices and in particular to a switching device which is designed to be compactly mounted within the screw base of a conventional electric lamp.

2. Description of the Prior Art

It is known to operate a pair of incandescent filaments so that upon failure of a primary filament an automatic switching device substitutes a secondary filament for the failed primary. A known multi-filament lamp employs a fusible conductor which restrains a spring-leaf contact. Upon failure of a primary filament the surge of current associated with failure ruptures that fusible conductor, releasing the spring-leaf contact and causing it to substitute the secondary filament for the failed primary filament. In another known example of such devices, an insulator which separates a pair of contacts breaks down upon failure of a primary filament and allows these contacts to close and substitute a secondary filament for the failed primary filament.

These known filament switching devices have generally required significant amounts of space within the screw base of a light bulb. Accordingly, manufacturers of light bulbs would require specialized machinery to handle an enlarged screw base. Moreover, the enlargement of the screw base would result in a longer lamp or in a bulb shortened to account for the enlarged screw base. Such a change in dimension or shape can be unacceptable in certain applications. Another practical impediment to successful implementation of a filament switching device has been containment of the fragments resulting from the fusing of the fusible conductor. Known devices have not had provisions for preventing such hot fused fragments from striking the fragile glass bulb. Such inadvertent contact on the glass bulb can cause its breakage which results in air leakage. Therefore, any attempt to commercialize a light bulb having an automatically switched pair of filaments would be unsuccessful.

The present invention avoids such problems and disadvantages by mounting a cantilevered and a fixed contact within a frame having a frame which branches in two directions. Since the frame branches in two directions it can fit around the evacuation tube of a conventional light bulb and thus compactly fit within the convention screw base of such a bulb. These contacts are employed to automatically substitute another filament for a failed filament. Accordingly, a reliable light bulb can be efficiently and inexpensively manufactured using the conventional size screw base, exhaust tubing, and dual filament mount.

Moreover, since fabrication of a dual filament light bulb is commonplace, the present switching device can be readily incorporated into existing manufacturing lines without redesign or modification of the dual filament bulbs. Also, since its screw base need not be elongated or enlarged the lamp can maintain its standard length and shape.

Since any incandescent filament has an inherently limited life, the effective life of an incandescent lamp according to the present invention can be doubled without sacrifice in luminous efficacy. This is a significant achievement, since any appreciable extension in filament life of commercial lamps necessitates lowering of the operating temperature of the filament which inevitably decreases luminous efficacy. Therefore, the so-called long life bulbs available commercially are undesirable for energy conservation. But redundancy provides reliability, which is extremely important for applications where it is prohibitively expensive or impractical to routinely replace the light bulbs. Exemplary prior art are U.S. Pat. Nos. 2,049,338 and 2,217,794.

In one embodiment, the frame of the switching device branches in two directions but is bridged by a cross-piece which thereby forms a central passageway. This passageway is sized to receive the evacuation tube so that the switching device is mechanically self-aligning and compactly mounted within the associated screw base. It is also preferable that the frame of the switching device be a pair of complimentary shells shaped to fit together and encompass the fusible conductor, thereby entrapping fused fragments which may issue therefrom.

Preferably, the frame of the switching device contains the cantilevered contact in one branch and the fusible conductor in the other branch. This cantilevered contact can be designed to swing transversely to the axis of the evacuation tube. This latter feature insures that the switching device compactly fits within a conventional screw base.

SUMMARY OF THE INVENTION

In accordance with the illustrative embodiment demonstrating features and advantages of the present invention there is provided in an electric light, a filament switching device. This electric light has a translucent bulb sealing at least two filaments. These filaments are coupled by lead wires into a screw base. The above mentioned filament switching device includes a frame, a fixed contact, a cantilevered contact, a fusible conductor and a holding means. The frame has a floor which branches in two directions. The fixed and cantilevered contacts are attached to the frame. The cantilevered contact is operable to deflect laterally over the floor of the frame. This cantilevered contact is positioned to flex upon separation from the fixed contact. The frame has a holding means for restraining one end of the fusible conductor. Its other end is connected to the free end of the cantilevered contact. This holding means is operable, through the fusible conductor, to separate the cantilevered contact from the fixed contact.

According to an associated method, also in accordance with the present invention, there is provided a method for assembling an electric light. This electric light has a translucent bulb with an axial evacuation tube. The bulb seals a pair of filaments that are coupled by two pairs of lead wires to a screw base by means of the filament switching device. This switching device is mounted in a frame that branches in two directions. The method includes the steps of positioning the frame to straddle the evacuation tube. The method also includes connecting one of the lead wires from each of the pair of filaments to the device. Another step is mounting the screw base on the bulb to encircle the frame.

BRIEF DESCRIPTION OF THE DRAWINGS

The above brief description as well as other objects, features and advantages of the present invention will be more fully appreciated by reference to the following detailed description of the presently preferred but nonetheless illustrative embodiment in accordance with the present invention, when taken in conjunction with the accompanying drawings wherein:

FIG. 1 is an elevational view of a conventional monofilament bulb as known in the prior art;

FIG. 2 is an elevational view of a conventional screw base associated with the apparatus of FIG. 1, as known in the prior art;

FIG. 3 is an elevational view of a conventional dual filament 3-way light bulb as known in the prior art;

FIG. 4 is a fragmentary elevational view along lines 4—4 of FIG. 3;

FIG. 5 is an elevational view, partly in section, of a switching device according to the present invention mounted on a screw base and bulb as shown in FIGS. 2–4;

DETAILED DESCRIPTION OF THE PREFERRED EMBODIMENT

Figure 6:
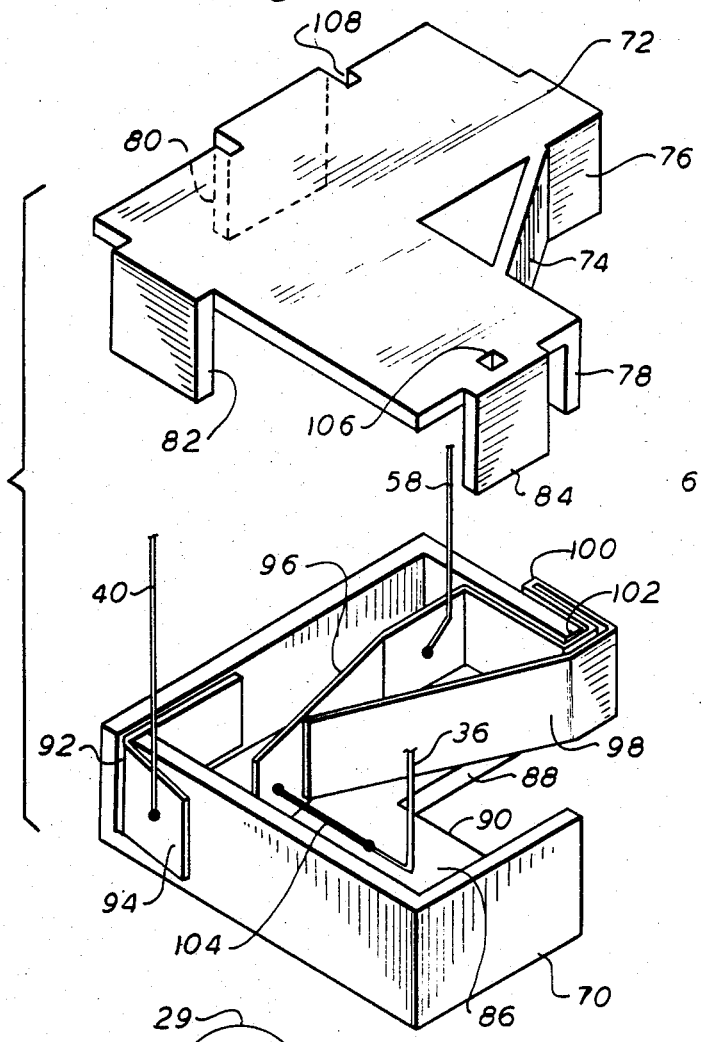
FIG. 6 is an exploded view of the switching device of FIG. 5.

Referring to FIG. 1, a conventional translucent bulb 10 is shown fragmented to expose an evacuation tube 12. This known device has an evacuation tube 12 which is flattened at its upper end 16 to provide a mounting base for imbedded lead wires 18 and 20 which support incandescent filament 14. Referring to FIG. 2 there is shown a conventional dual terminal screw base to which the lead wires of the incandescent bulb of FIG. 1 are typically connected. One terminal of screw base 22 is axial eyelet 24 which is a concentric metal button. The other terminal of screw base 22 consists of metal shell 26 into which are formed threads 28.

Referring to FIG. 3, a conventional dual filament incandescent light bulb is illustrated. Bulb 29 houses a pair of filaments 30 and 32 which are mounted on lead wire pair 34 and 36 and lead wire pair 38 and 40, respectively. These lead wires are shown imbedded within evacuation tube 42 at its upper press 44. Referring to FIG. 4, a fragmentary elevational view along lines 4—4 of FIG. 3 is given. This view clearly illustrates the spacing between the lead wires 34 and 38. It is to be understood that lead wires 36 and 40 similarly are spaced but are hidden herein by lead wires 34 and 38, respectively. It can also be clearly seen from this figure that the press 44 of evacuation tube 42 has a split or forked cross-section.

Figure 7:
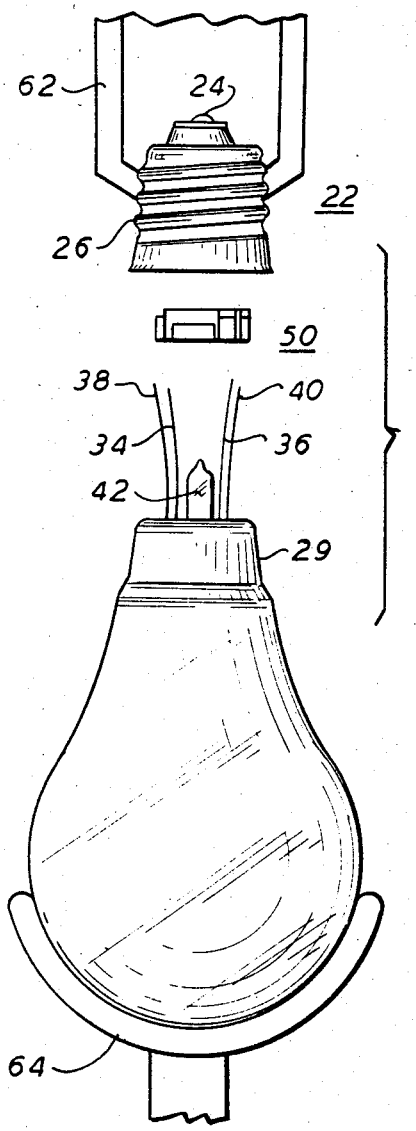
FIG. 7 is an exploded view of the apparatus of FIG. 5.

Referring to FIGS. 4, 5, and 7, these figures show the installation of switching device 50 within screw base 22 adjacent bulb 29. It will be noted that bulb 29 is the dual filament bulb of FIG. 3. It will also be observed that when fully assembled, evacuation tube 42 is encompassed by switching device 50, in this embodiment. It can also be observed herein that screw base 22 mounts eyelet 24 on insulating layer 52 which caps a tapered insulator 54. Insulator 54 has a tapered axial aperture 56 through which lead wire 58 is routed. The metal shell 26 is bonded to bulb 29 by cement 60.

A placing member 62 (FIG. 7) is shown as part of the conventional assembly apparatus used in a production line to assemble screw base 22 and its associated switching device 50 to bulb 29. Bulb 29 is held in place by conventional fixture 64.

Figure 10:
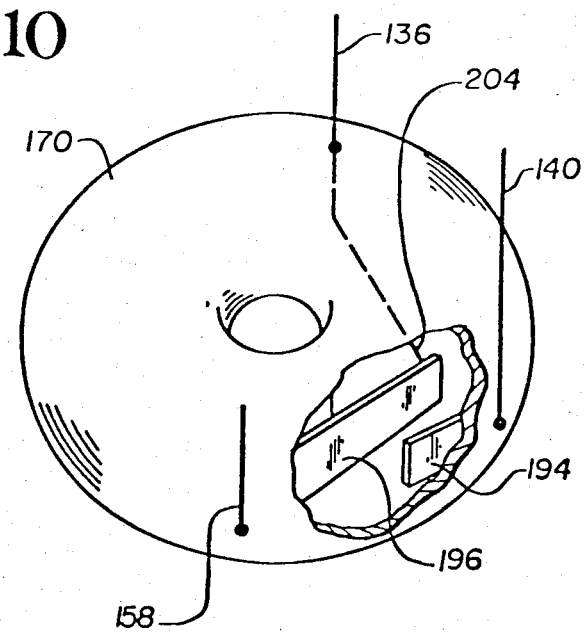
FIG. 10 is a perspective view of a switching device which is an alternate to that of FIG. 6.

Referring now to FIG. 6, an exploded view is given of the switching device previously illustrated in simplified form in FIGS. 5 and 7. A frame is shown herein as a pair of complementary shells, comprising base 70 which can be sealed by a cover 72. In this embodiment shells 70 and 72 fit together to form a hollow chamber having two orthogonal branches. However, it will be appreciated that for other embodiments the frame can have other branched shapes including closed shapes such as a hollow toroid having a central aperture sized to receive the previously described evacuation tube. FIG. 10 shows such a toroidal frame wherein components corresponding to components in FIG. 6 have reference numerals increased by one hundred. In this embodiment of FIG. 6 the frame includes a cross-piece 74 which spans the two orthogonal branches of cover 72. Essentially, cover 72 is an "L" shaped plate having depending therefrom, two joined orthogonal walls 76 and 78. The purpose of the cross-piece 74 is to form a small, triangular opening with the "L" shaped frame through which the exhaust tubing 42 is positioned, and to restrict any lateral movement of the frame, which might otherwise interfere with the installation of the lamp base during assembly. In addition, cover 72 has three downwardly depending tabs 80, 82 and 84 which hold cover 72 in position when mouunted upon base 70. Base 70 has a floor 86 that has a general "L" shape. Floor 86 has four upstanding walls integrally attached to its edges, except for edges 88 and 90.

Figure 9:
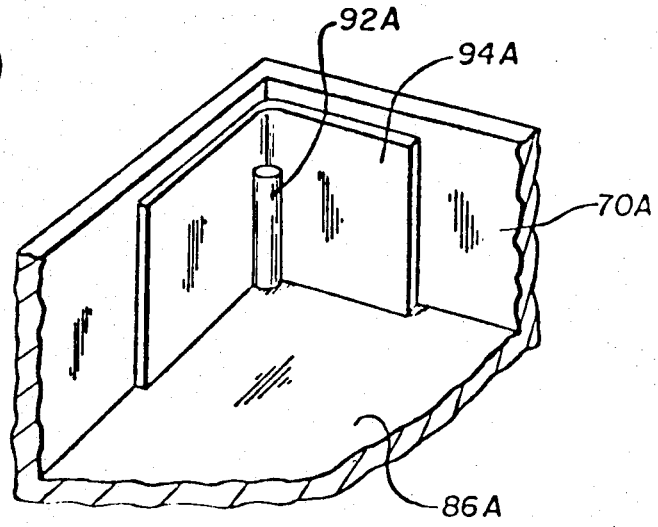
FIG. 9 is a partial fragmentary view showing an alternative construction of a portion of the invention.

Mounted in side slit 92 is a fixed contact shown herein as a bent metallic tab 94 whose outer portion is connected to previously illustrated lead wire 40. It will be appreciated that other means for mounting tab 94 are possible including adhesives. In the embodiment of FIG. 9, 92A in floor 86A, an upright peg adjacent to an inside corner of frame 70A behind which bent tab 94A can be mounted. A moveable contact is shown in FIG. 6 as a continuous metal strip comprising a leading strip segment 96 and an oblique strip segment 98. Segments 96 and 98 are formed from a continuous strip which is bent into a U-shaped clip 100 at its mid-section. Clip 100 is slipped over edge 102 of frame 70. It will be appreciated, however, that in some embodiments oblique segment 98 may be omitted and that cantilevered segment 96 can be affixed in alternate manners including adhesive mounting or an upright peg as previously described in connection with fixed contact 94. Segments 96 and 98 are shown in a retracted or open position. These two segments would, if unrestrained, swing so that segment 96 electrically contacts fixed contact 94. However, segments 96 and 98 are held and restrained in the position illustrated by means of a fusible conductor, shown herein as thin wire 104. Conductor 104 is connected between the free end of cantilevered contact 96 and lead wire 36. A holding means is shown herein as aperture 106 in cover 72. Lead wire 36, and thus conductor 104 and contact 96, are restrained in the position illustrated by means of aperture 106 in cover 72. Essentially, the upright portion of lead wire 36 is routed through aperture 106 which then restrains that lead wire from lateral movement. Accordingly, so long as conductor 104 is intact, cantilevered contact 96 is restrained from deflecting back into electrical contact with fixed contact 94. It will be appreciated that other means for restraining conductor 104 are possible. For example, the end of conductor 104 opposite the free end of cantilevered contact 96, may be connected to a terminal which is molded into a side wall of base 70. When assembled, lead wire 58 is routed through matching notch 108 in cover 72.

When cover 72 is placed atop base 70, it and its walls 76 and 78 seal base 70 so that fragments from fusible conductor 104 are captured. Accordingly, fused fragments from conductor 104 cannot come into contact with an evacuated glass bulb and crack it. This is of great importance for otherwise the molten metal upon contact with the glass will likely crack the glass, cause leakage of air into the bulb and thus, burn out the filament.

Figure 8:
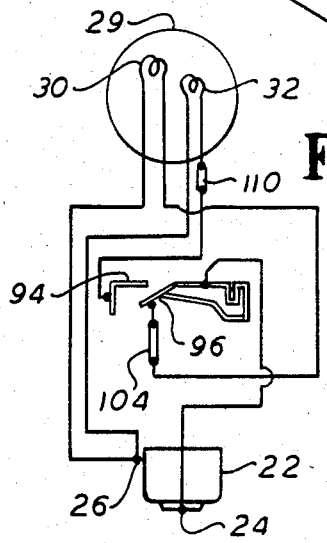
FIG. 8 is a schematic representation of the electrical connections associated with the apparatus of FIG. 5.

FIG. 8 is a schematic representation of the connection between filaments 30 and 32 to the previously described switching device and screw base. One terminal each of filaments 30 and 32 are connected to the metal shell 26 of screw base 22. Each remaining terminal of filaments 30 and 32 is connected to one end of fusible conductor 104 and fuse element 110, respectively. The other ends of conductors 104 and 110 are connected to cantilevered contact 96 and fixed contact 94, respectively. Fusible conductor 104 has been previously described. Fuse element 110 is similarly constructed and is welded in series with filament 32. Cantilevered contact 96 is also connected to the eyelet 24 of screw base 22.

To facilitate an understanding of the foregoing apparatus, its operation will be briefly described. As manufactured cantilever contact 96 is in the position shown in FIGS. 6 and 8. Accordingly, an electrical connection exists from eyelet 24 (FIG. 8) through fusible conductor 104 to one terminal of filament 30, the other terminal of filament 30 being commonly connected to the threaded metal shell 26 of screw base 22 (FIG. 8). It is well known that filament failure is frequently preceded by a gradual thinning of the cross-sectional area of the filament. Such thinning can be caused by migration of gasseous impurities towards a "hot" spot on the filament. Such a thinned cross-section causes a localized high resistance which creates a localized hot spot. At failure, as the filament separates a plasma state exists and thus causes a high flux of current to suddenly rush across the point of rupture. Accordingly, the fusible conductor is overheated and melted by the high current flowing through it. Accordingly, conductor 104 ruptures and allows cantilevered contact 96 to swing into contact with fixed contact 94. The swing of cantilevered contact 96 is motivated by release of its internal tension as well as the urging from oblique segment 98. Upon rupture of conductor 104 the connection between eyelet 24 and filament 30 terminates. Upon closure of contacts 94 and 96, eyelet 24 is connected through fusible conductor 110 to one terminal of filament 32. The other terminal of filament 32 being commonly connected to metal shell 26, current flows through filament 32. This sequence completes the substitution of filament 30 with filament 32.

Upon a similar failure of filament 32, an inrush of current melts fuse element 110. The melting of this conductor protects the main power lines and prevents excessive current.

The manufacture of the foregoing apparatus can be achieved with conventional hardware and manufacturing implements. Moreover, many of the components will be common to conventional lamps.

Referring to FIGS. 6 and 7, assembly proceeds by fitting switching device 50 over evacuation tube 42 while connecting lead wires 40 and 36 to fixed contact 94 and fusible conductor 104, respectively, within device 50. Next a connection is made between eyelet 24 of screw base 22 to cantilever contact 96 of device 50. Thus connected the remaining two lead wires 34 and 38 are connected to the threaded metal shell 26 of screw base 22. Finally, the screw base 22 is cemented onto the neck of bulb 10 in a conventional fashion. Thus assembled the device is ready for use and will operate in the manner previously described.

It is to be appreciated that modifications and alterations can be implemented with respect to the apparatus just described. For example, various materials can be used to fabricate the frame and its contact. It is anticipated that molded plastic or other insulators can be used to fabricate the frame. Moreover, the specific shape and dimensions of the various components can be altered as a matter of design. In addition, it is expected that the cantilevered contact can be motivated by its internal tension or alternatively, by a permanent magnet. In addition, various other materials of different dimensions can be substituted to provide the desired size, shape, wear, power handling capability, temperature stability, sensitivity to current surges, etc. Obviously, many other modifications and variations of the present invention are possible in light of the above teachings. It is therefore to be understood that within the scope of the appended claims, the invention may be practiced otherwise than as previously described.

Figure 11:
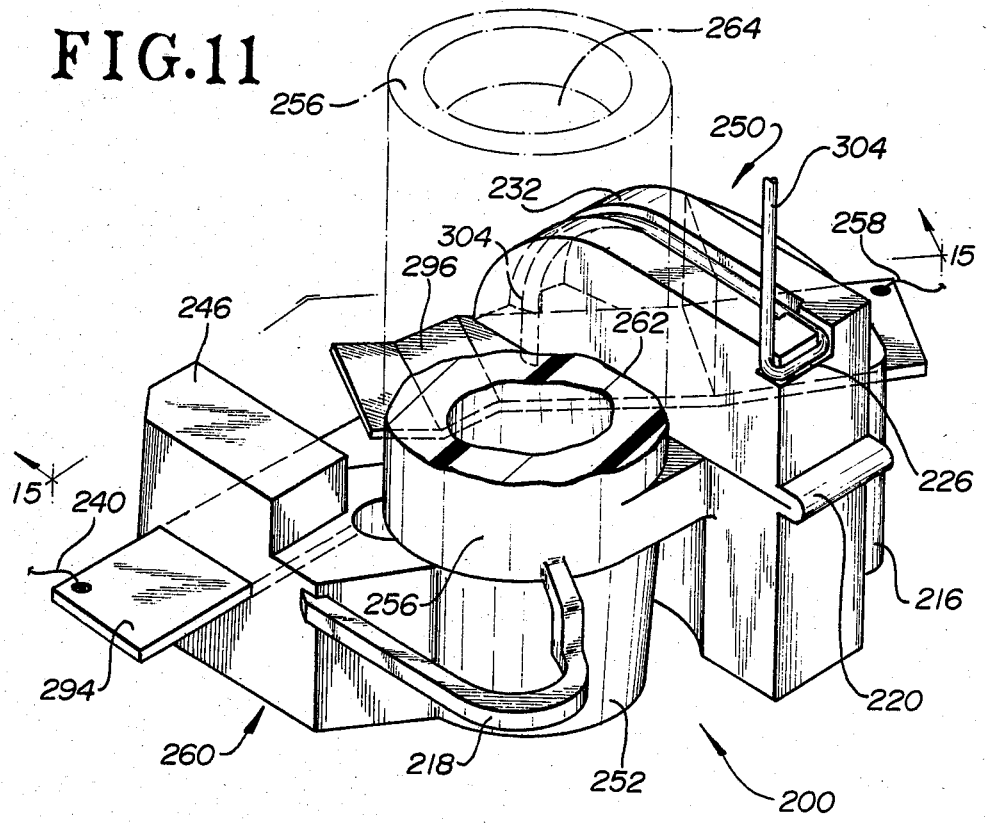
FIG. 11 shows a perspective view another embodiment of the switching device in its assembled position ready for installation of the switching device around the evacuation tube of the light bulb.
Figure 12:
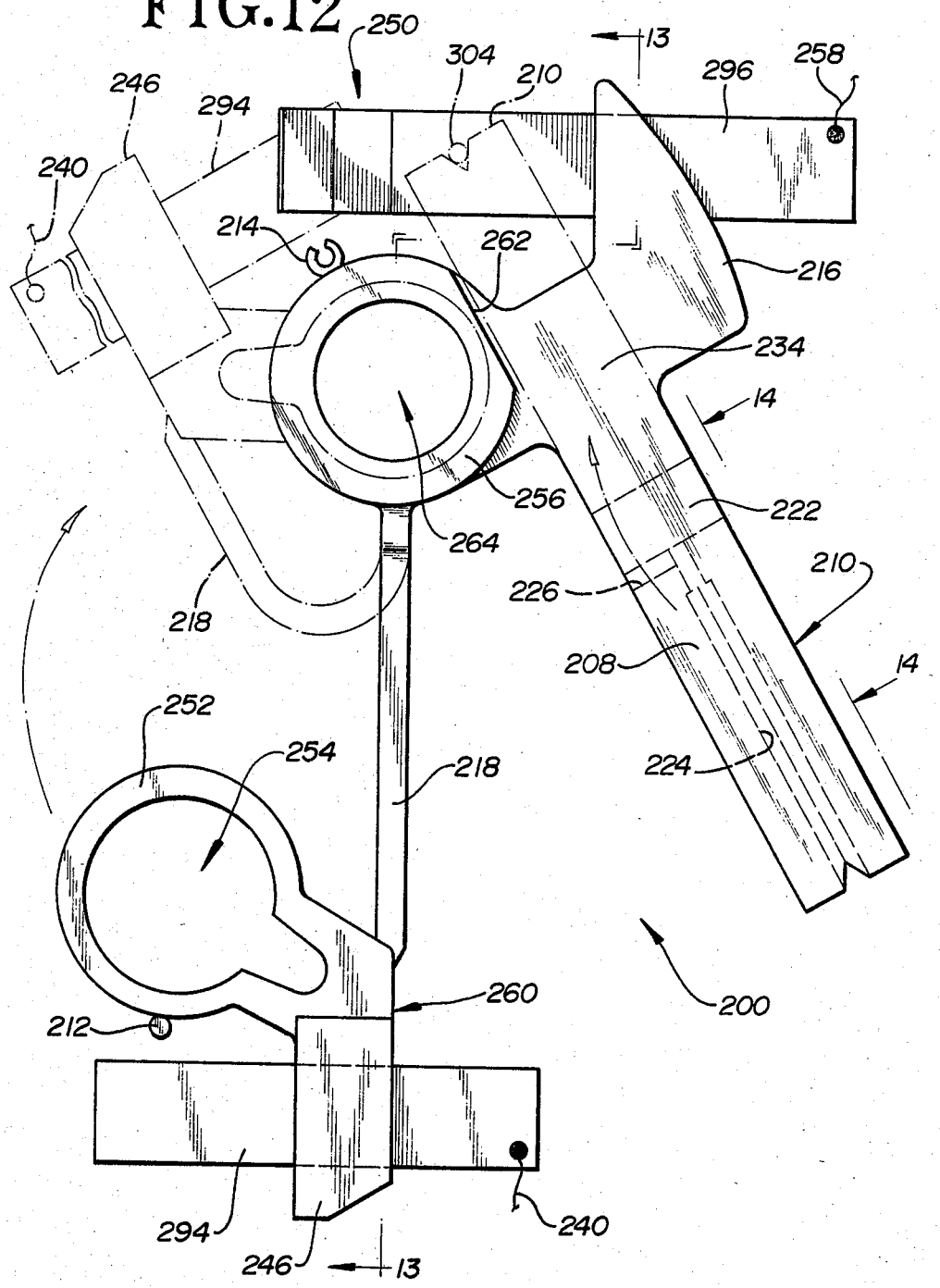
FIGS. 12 and 13 show a top plan view and a side view partially in sections along lines 1313 in FIG. 12 showing the device in unassembled form.
Figures 13, 14:
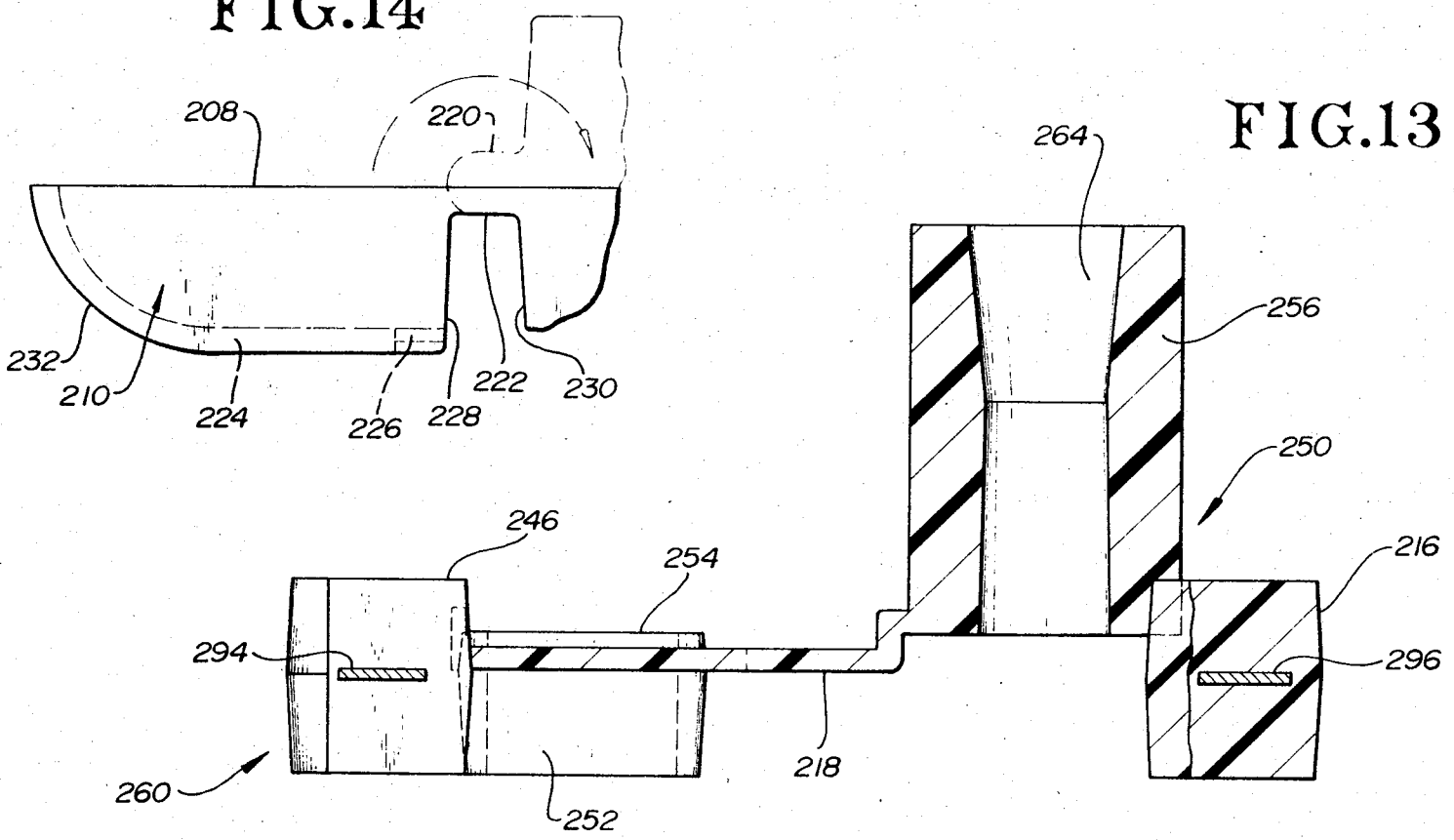
FIG. 14 is a partial side view taken along lines 1414 in FIG. 12.

As shown in FIGS. 11 and 12, another embodiment of the invention is adapted to fit around the evacuation tube of the light bulb in the assembled form as a cylindrical passageway through which the evacuation tube will pass. When assembled, the cylindrical passageway is formed through ends of the device which are bent around to form the passageway.

Referring to FIGS. 11 and 12, we have a one piece molded unit generally indicated as 200 formed from a plastic material in which two flat metal strips are insert molded into the plastic material during the molding operation. The molded object consists of an upper section or bend 250 having a cylindrical barrel 262 and a claw 216 extending upward into which is insert molded the flat metal strip 296 across the claw 216. Extending from the head portion 250 of the device is an extended tail section 210 connected by means of a narrow strip 220 which will form a living hinge 220 when bent over in assembled form. The tail portion has a curved or arcuate bottom or ramp surface 232 and a flat top surface 208 which is adapted to contact the upper surface or neck 234 of the head near the cylindrical portion 256. Note that the outer wall portion 262 of the cylindrical portion 256 of the head is flattened to allow for the bending over of the tail portion to lie against the top or neck portion for purposes to be explained later. The foot portion 260 of the switching device has another or second tubular portion 252 which is adapted to connect to the first tubular portion and the head portion of the switching device by means of a narrow ligament 218. The foot portion has a built up toe 246 extending from the tubular section 252 in which is insert molded a second metallic strip 294 which will be the fixed contact.

To assemble the switching device, the item is received from the mold in the manner shown in FIG. 12 with the toe portion extending substantially out from the body portion and the tubular portion of the head. Contact wire 240 is connected to the fixed contact at the extension of the fixed contact strip 294 projecting beyond the built up toe 246. A contact wire 258 is also connected to the portion of the cantilevered member 296 extending from the claw 216 on the side remote from the upper tubular portion 256. Finally, the fuse segment 304 is connected to the top of cantilevered contact member 296 projecting from the side of the claw adjacent to the tubular section 256 and towards the edge remote from the claw 216 in order to obtain greater mechanical advantage. The end of the cantilevered contact section is bent in a V shape and then the entire section is bent downward to provide a natural downward attitude to give a resilience to the strip material during stages of further assembly.

Figure 15:
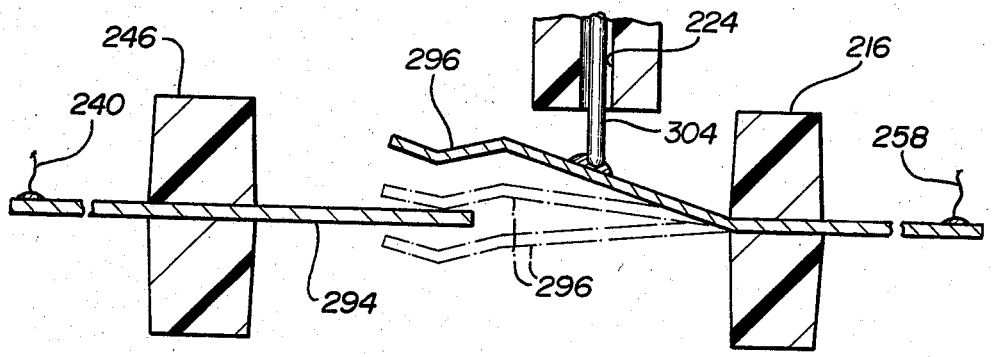
FIG. 15 is a partial view showing the relationship of the fixed and moveable contact points of the device at various stages of its operation.

The tubular section 252 from the foot 260 is then brought around to align with the upper tubular section 256 by bending ligament section 218. The head and foot tubular sections are aligned by means of extending finger 212 from the lower tubular section which will fit into and be captured by a receiving detent 214 formed in the outer wall of the head tubular section 256. In the properly aligned position, the fixed contact strip 294 will be positioned below the cantilevered member 296 at the portion overlapping. As the lower tubular section is brought into position relative the upper tubular section, the fixed contact strip 294 will edge the cantilevered contact 296 into the middle position shown in FIG. 15 so that the cantilevered contact 296 will be resting upon the fixed contact point of the fixed contact strip.

At this point, the tail portion 210 of the switching mechanism is folded by bending it over narrowed portion 222 which becomes the living hinge 220, so that it lies as previously mentioned against the outer tubular wall of the tubular head portion. The fuse wire 304 which has been previously welded to the cantilevered member 296 is now drawn through slot 224 in the upper portion of the folded over tail and drawn back to the end of the slot where there is a second and transverse slot 226 in the very back portion of the body, having a tapered end adapted to engage and capture the fuse wire so that the fuse wire will be bent at a right angle from the slot 224 in the upper surface. From that point, the slot 226 also curves slightly upward to enable the fuse wire 304 to be bent once again to carry it in a direction actually parallel to the evacuation tube (not shown).

Figure 16:
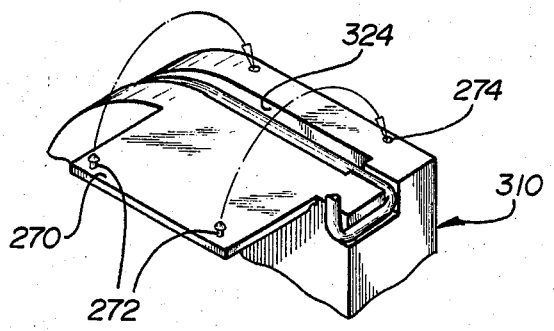
FIG. 16 is a partial view of another embodiment of the invention showing a closure means.
Figure 17:
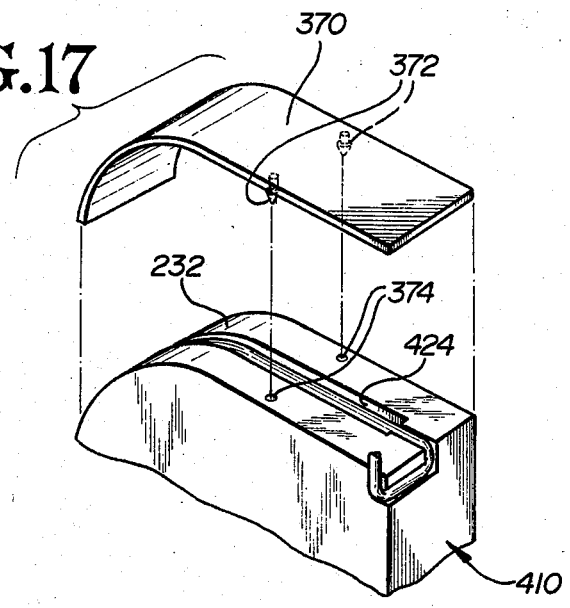
FIG. 17 is a partial view of another embodiment of the invention showing a different closure means.

FIGS. 16 and 17 show additional embodiments in the invention in which means are provided to enclose the fuse wire so that when it fragments upon failure of the fuse, the pieces will not be allowed to scatter within the envelope of the bulb to cause breakage to the evacuation tube or to the envelope and thereby destroy the seal in the bulb.

As shown in FIG. 16, the method for enclosing the fuse wire is to provide a thin flap 270 extending from the lower curved portion of the tail 310 which can be folded over groove 324 in which the fuse wire will be laid, and the flap 270 will then be secured by means of projections 272 which will snap into receptacle passages 274.

As shown in FIG. 17, a similar device is used, however, rather than have the flap as a one-piece extension of the tail portion, a separate flap 370 is provided which has a shape that makes the arcuate surface 232 of the tail 410. This separate cover 370 is fastened over slot 424 by means of projections 372 extending through cover 370 and adapted to engage in the passages 374.

It should be noted that the invention possesses all of the advantages of the previous embodiments. The orientation of the cantilevered member is different from that of the previous switching device, although the device is still small enough to fit within the dimensions of the standard monofilament or multi-filament light bulb. Additionally, the device completely surrounds the evacuation tube and is adequately permanently positioned in that relationship.

Also, by having all of the metallic contact points clearly exposed prior to assembly, the welding operations or other methods by which the lead wires are connected to the switching device is greatly facilitated. Further, since the item is molded in one piece, size and dimensional requirements are greatly simplified and uniformity is assured. Also, the assembly is greater simplified since it requires merely three spot welds done in clearly open and accessible areas and then two simple folding devices to align the portion into the complete assembly.

Further, by using separate single surface cover members to enclose the slot for the fuse wire, it is possible to prevent scattering of the fuse wire fragments after breakage of the fuse.

Note that in all circumstances, intricate or delicate manipulation of components is completely avoided. The devices are made as a substantially single unit. Any cover that has to be incorporated is merely snapped into place.

It will be understood that the various changes in the details, materials, arrangements of parts and operating conditions which have been herein described and illustrated in order to explain the nature of the invention, may be made by those skilled in the art, within the principles and scope of the invention.

What is claimed is:

1. In a multi-filament incandescent light bulb having a transparent or translucent evacuated bulb mounted in a screw type base and containing first and second filaments adapted to be electrically connected with electrical power supply contacts on said base, said bulb having an evacuation tube extending from said bulb into said base, a switching device in said base extending at least partially around said evacuation tube, and means in said switching device for automatically connecting said second filament to said power supply contacts upon failure of said first filament.

2. The multi-filament incandescent light bulb as claimed in claim 1 wherein:

said switching device in said base includes a tube portion having passage means for said evacuation tube; and said evacuation tube extends into said passage means of said tube portion.

3. The multi-filament incandescent light bulb as claimed in claim 2 wherein said tube portion comprises:

an upper and a lower tube portion in axial alignment; and said evacuation tube extending into each of said upper and lower tube portions.

4. The multi-filament incandescent light bulb as claimed in claim 3, further comprising:

a head portion connected with said upper tube portion;

a foot portion connected with said lower tube portion; and means connecting said upper and lower tube portions.

5. The multi-filament incandescent light bulb as claimed in claim 3, further comprising:

a first contact strip connected with said upper tube portion;

a second contact strip connected with said lower tube portion; and means to hold said first contact strip out of contact with said second contact strip until failure of said first filament.

6. The multi-filament incandescent light bulb as claimed in claim 5 wherein said means to hold said first contact strip out of engagement with said second contact strip comprise:

a fuse member connected to said first contact strip, and said first filament; and securing means to fix said fuse member relative said first contact strip and hold said contact strip in tension.

7. The multi-filament incandescent light bulb as claimed in claim 6 wherein said securing means to fix said fuser member relative said first contact strip comprise:

a body portion connected with said head portion; and a slot on said body portion to receive conductive means coacting with said fuse member.

8. The multi-filament incandescent light bulb as claimed in claim 7 further comprising closure means connected to said holding means to prevent fragments of said fuse means from disbursing.

9. The multi-filament incandescent light bulb as claimed in claim 3 wherein said means connecting said upper and lower tube portions comprise an elongated flexible member enabling movement between said upper and lower tube portions.

10. The multi-filament incandescent light bulb as claimed in claim 9 wherein mating locking members on said upper and lower tube portions to secure said upper and lower tube portions in axial alignment.

11. A switching device for a multifilament incandescent light bulb for automatically connecting a second filament to a power supply upon failure of a first filament comprising:

means to receive an evacuation tube of said light bulb;

a movable contact connected to said means to receive an evacuation tube;

a fixed contact;

means flexibly connecting said fixed contact with said means to receive an evacuation tube;

said movable contact connected to a power source;

said fixed contact connected to said second filament;

said movable contact connected to a fuse means between said first filament and said movable contact; and means to space said contact from said fixed contact until said fuse means severs.

12. A switching device for a multifilament incandescent light bulb as claimed in claim 11 wherein:

said means to receive an evacuation tube of said light bulb comprise:

a first and a second tube portion; and said fixed contact and said movable contact connected to separate one of said first and second tube portions.

13. A switching device for a multifilament incandescent light bulb as claimed in claim 12 wherein said means to space said movable contact from said fixed contact until said fuse means severs comprises:

means to hold said fuse means in tension to resiliently space said movable contact form said fixed contact; and said movable contact being urged to contact said fixed contact upon severing of said fuse means.

14. A switching device for a multifilament incandescent light bulb as claimed in claim 13 wherein:

said means to hold said fuse means in tension comprise:

a slotted body spaced from said movable contact; and said fuse member connected with said slotted body to fix the position of said fuse member.

15. A switching device for a multifilament incandescent light bulb as claimed in claim 14 further comprising:

flexible connecting means connecting said first and second tube portion; and aligning means to axially align said first and second tube portions to enable passage of an evacuating tube through said assembled first and second tube portions.

16. A switching device for a multifilament incandescent light bulb as claimed in claim 15 further comprising cover means attachably connected to said slotted body to cover said slot and prevent dispersal of fragments from said failed fuse section.

17. A method of assembling a switching device for automatically connecting a second filament of a multi filament bulb upon failure of the first filament in the bulb, comprising the steps of:

connecting a conductor to a first contact strip;

connecting a conductor to a second contact strip spaced remotely from said first contact strip;

connecting a fuse member to said first contact strip;

aligning first and second receptacles for evacuation tubes of bulbs, connected to said respective first and second contact strips to position said first and second contract strips; and tensioning said fuse member to resiliently space said first and second contact strips until said fuse member fails.

18. The method of claim 17 comprising the additional step of enclosing said fuse member to prevent scattering of fuse fragments upon failure of the fuse.

19. The method of claim 17 wherein the step of aligning first and second receptacles for evacuation tubes includes axially aligning first and second tubular segments; and fixing the segments together.

20. The method of claim 19 comprising the further step of bending one of said contact strips to provide resilience for urging contact between the first and second contact strip upon failure of the fuse means.

* * * * *